United States Patent [19]

Collgon

[11] 4,360,060

[45] Nov. 23, 1982

[54] HOLLOWED PLATE FOR A HEAT EXCHANGER WITH FLUID FLOW TUBES

[75] Inventor: Pierre Collgon, Le Rotrou, France

[73] Assignee: Valeo, Paris, France

[21] Appl. No.: 269,778

[22] Filed: Jun. 3, 1981

[30] Foreign Application Priority Data

Jun. 5, 1980 [FR] France ..... 80 12550

[51] Int. Cl.[3] ..... F28F 9/02

[52] U.S. Cl. ..... 165/173

[58] Field of Search ..... 165/149, 153, 173, 175

[56] References Cited

U.S. PATENT DOCUMENTS

| | | | |
|---|---|---|---|
| 37,343 | 1/1863 | Hills | 165/175 |
| 244,762 | 7/1881 | Paul | 165/175 |
| 1,818,144 | 8/1931 | MacLeod | 165/44 |
| 2,639,899 | 5/1953 | Young | 165/175 |
| 2,862,694 | 12/1958 | Lortz | 165/76 |
| 3,027,142 | 3/1962 | Albers et al. | 165/149 |
| 3,265,126 | 8/1966 | Donaldson | 165/149 X |
| 3,583,478 | 6/1971 | Fieni | 165/175 X |
| 3,993,126 | 11/1976 | Taylor | 165/173 |
| 4,245,696 | 1/1981 | Van der Lelij | 165/173 X |

FOREIGN PATENT DOCUMENTS

| | | | |
|---|---|---|---|
| 2435632 | 2/1975 | Fed. Rep. of Germany | 165/149 |
| 1291617 | 12/1962 | France | 165/153 |
| 1350811 | 12/1964 | France | 165/173 |
| 2036701 | 12/1970 | France . | |
| 2137247 | 12/1972 | France . | |
| 2270543 | 11/1976 | France | 165/149 |
| 2371660 | 6/1978 | France . | |
| 622421 | 5/1949 | United Kingdom . | |
| 914539 | 1/1963 | United Kingdom | 165/149 |
| 1016251 | 1/1966 | United Kingdom . | |

*Primary Examiner*—Sheldon J. Richter

*Attorney, Agent, or Firm*—McAulay, Fields, Fisher, Goldstein & Nissen

[57] ABSTRACT

A hollowed plate for a heat exchanger with fluid flow tubes, formed with holes into which are engaged and tightly fitted the ends of tubes of the exchanger, and being of general bulging or deflected shape, for improving the compressive strength of said hollowed plate, particularly in a radiator for the cooling circuit of a motor vehicle engine.

12 Claims, 11 Drawing Figures

HOLLOWED PLATE FOR A HEAT EXCHANGER WITH FLUID FLOW TUBES

BACKGROUND OF THE INVENTION

Heat exchangers are known, for example to be used as radiators in cooling circuits of motor vehicle engines, which comprise a nest of finned tubes through which flows the engine cooling fluid and at least a collector formed of a plate with holes into which are engaged and tightly fitted the tube ends. To said plate is joined a water box which may comprise at least one fluid inlet or outlet pipe and which is attached to the plate via its edges, particularly by means of lugs or of bent flanges of said plate.

OBJECT AND SUMMARY OF THE INVENTION

The invention relates to a hollowed plate for such a heat exchanger with flow tubes for a fluid such as a liquid.

Generally, the hollowed plate is a plane, relatively thin and rectangular-shaped metallic plate.

During pressurizing tests of the exchanger, and sometimes even during the operation of the exchanger, it has been found that the pressure prevailing in the water box caused a deflection of the central portion of the hollowed plate, the deflection being in some cases to such an extent that the central portion of said plate came to bear on the end fins of the tubes of the nest. To this deflection of the central portion of the hollowed plate corresponds a displacement in the reverse direction of the angular regions or corners of said plate. Under such conditions, the ends of the tubes which are adjacent said corners are then supporting a large part of the deformation stresses, hence the risk that the tightness of the plate around the ends of said tubes is destroyed and that the heat exchanger is put out of use.

The object of the invention is to remedy such disadvantages by improving the deformation strength of the hollowed plate without increasing its thickness.

It provides thereto a hollowed plate, of small thickness, for a heat exchanger comprising fluid flow tubes, the ends of which are engaged and tightly fitted into the holes of the plate, wherein said plate is of general bulging or deflected shape and comprises preferably a substantially plane central portion, connected via slanting planes to the edges of said plate.

According to a further characteristic feature of the invention, the plate is depressed or deflected in the direction of the exchanger nest.

Thus, by providing the hollowed plate with an initial deflection of the same type as the one to which a plane plate would be subjected during pressurizing tests of the exchanger, its deflection strength is surprisingly improved without changing its thickness.

It has been established that a hollowed plate according to the invention has the same deflection strength than a plane plate of greater thickness, or that its deflection strength is superior to that of a plane plate of same thickness.

BRIEF DESCRIPTION OF THE DRAWINGS

In the following description which is given by way of example, reference is made to the accompanying drawings wherein.

DETAILED DESCRIPTION OF THE EMBODIMENTS

Figure 3:
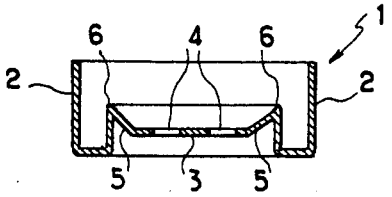
FIGS. 2 and 3 are cross-sectional views along line II—II and III—III respectively of FIG. 1.
Figure 1:
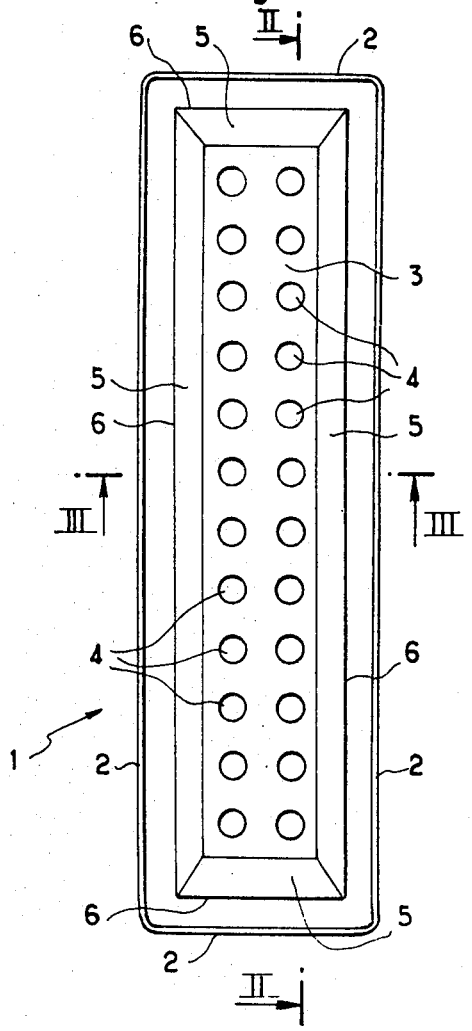
FIG. 1 is a plane schematic view of a hollowed plate according to the invention.
Figure 2:
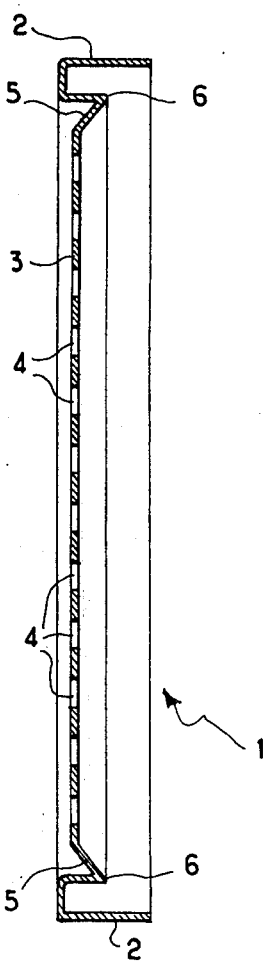

The hollowed plate 1 according to the invention, which is shown schematically in FIGS. 1 through 3, is a thin and substantially rectangular plate, with U-shaped edges 2 provided for the mounting of a water box the edges of which fit tightly inside the U-shaped edges 2.

The plate comprises a central portion 3, deflected, in which are formed holes 4 for the tight fitting of the ends of the finned tubes forming the exchanger body. The central portion 3 is connected to the U-shaped edges 2 of said plate via slanting planes 5 at its ends, and it is itself substantially plane. Thus, its position is at a lower level than the ends 6 of the slanting planes 5 connected to the U-shaped edges 2.

Such a hollowed plate offers a better resistance to the dynamic pressures prevailing in the water box during the operation of the exchanger than a hollowed plate of the prior art, of general plane shape and the central portion of which would be situated at the same level as said ends 6, while on the other hand the risk for the tubes mounted in the holes 4 close to the slanting planes 5 to get loose is substantially suppressed.

Figure 4:
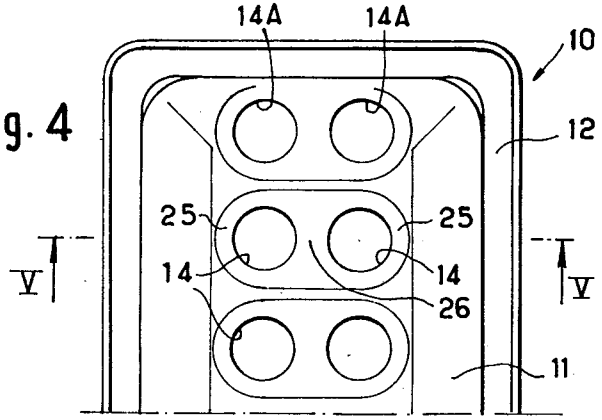
FIG. 4 is a plane view of a portion of the hollowed plate according to a first embodiment of the invention.

In FIG. 4 is shown an end portion of a hollowed plate 10 according to an embodiment of the invention, formed of a thin metallic plate 11, rectangular, with U-shaped edges 12 (FIG. 5) for the fitting of a water box 13, in the usual way.

The plate 11 comprises two longitudinal and parallel rows of holes 14, in transverse alignment two by two, and its edges which are folded perpendicularly to the plate 11 form cylindrical collars 15 protruding on said plate on the side opposite to the water box 13.

On its opposite face, the plate 11 is coated with a rubber sheet 16, or similar, forming a tight seal.

The body of the heat exchanger is a nest of finned tubes 19, of known type, the ends of which are provided with at least one flared-out or enlarged portion, or with a double flared-out portion 20, 21, as in the example shown. This flared-out portion, or this double flared-out portion, allows fitting tightly the end of tube 18 in a hole 14 of plate 11, the sealing joint 16 being formed, adjacent each hole, with a tubular cylindrical collar 22 which is tightly clamped between the cylindrical collar 15 of each hole of the plate and the double flared-out portion 20, 21 of the corresponding tube 18.

The hollowed plate 11 is of general bulging or deflected shape and has a sag increasing progressively from its edges towards its central portion which can be defined as a portion comprising all the holes 14 for mounting the ends of tubes 18, except the four holes 14A adjacent the corners of said plate. Preferably, the plate 11 is deflected on the side of the tube nest 18, viz. on the side opposite the water box 13.

As hereabove mentioned, the dynamic pressure prevailing in the water box 13 on the one hand causes a deformation or a deflection of plate 11 which is less than if the plate was plane, and on the other hand the corners of plate 11, comprising the holes 14A, do not tend any more to get deformed in the opposite direction, viz. upwards towards the water box, thereby avoiding the loosening of the end tubes fitted into said holes 14A and the risk of the heat exchanger being put out of service.

In said embodiment, the collars 15 of the holes 14 are surrounded by an annular shoulder 25 formed by a bent portion of plate 11, the top of which being at the level of the non deflected edge portions of said plate 11. The shoulders 25 surrounding two transversely adjacent cylindrical collars 15 are connected to each other via a plane portion 26 which is at the same level as the top portions of said shoulders.

Figure 6:
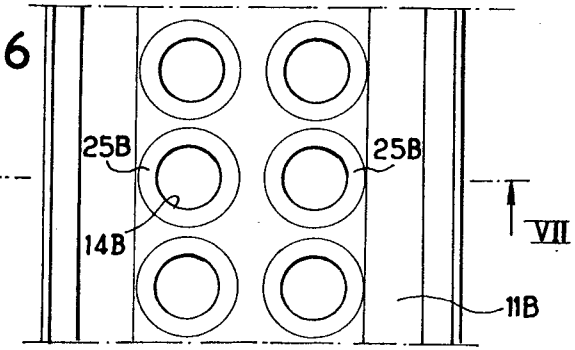
FIG. 6 is a plane view of a portion of the hollowed plate of another embodiment of the invention.
Figure 5:
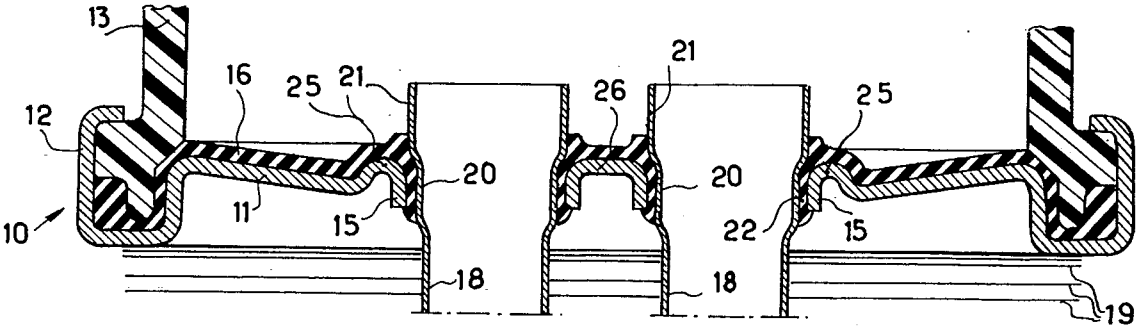
FIG. 5 is a cross-sectional view at a larger scale along line V—V of FIG. 4, showing the hollowed plate mounted on the tube nest and supporting the exchanger water box.
Figure 7:
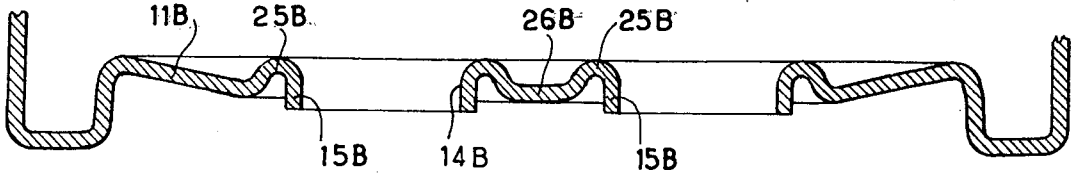
FIG. 7 is a cross-sectional view at a larger scale along line VII—VII of FIG. 6.

The alternative embodiment shown in FIGS. 6 and 7 is different from that of FIGS. 4 and 5 in that, the upper portions of shoulders 25B surrounding the collars 15B of holes 14B of plate 11B being at the same level as the non deflected edge portions of said plate 11B, two transversely aligned shoulders 25B are connected to each other via a portion 26B which is at a lower level than that of the top of said shoulders.

Figure 8:
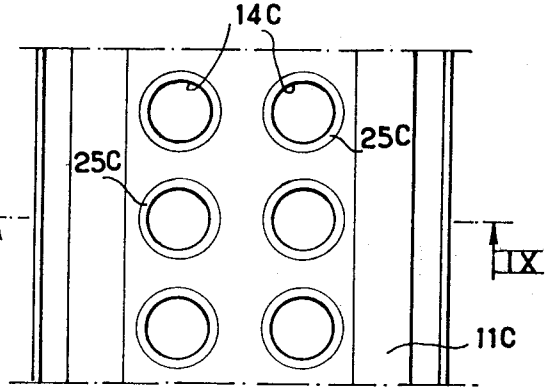
FIG. 8 is a view similar to FIG. 6, but for an alternative embodiment.
Figure 9:
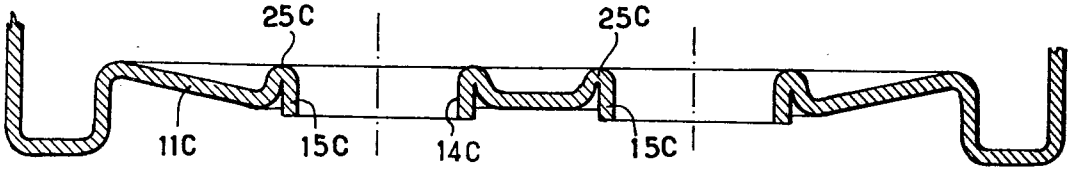
FIG. 9 is a cross-sectional view at a larger scale along line IX—IX of FIG. 8.

The alternative embodiment shown in FIGS. 8 and 9 is different from that of FIGS. 6 and 7 in that the shoulders 25C surrounding the collars 15C of holes 14C of plate 11C have touching edges, i.e. that the bent portion of the plate 11C which forms each shoulder 25C is applied against the collar 15C.

Figure 10:
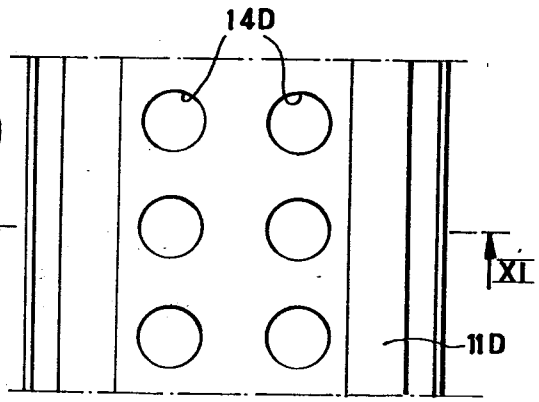
FIG. 10 is a plane view of a portion of a hollowed plate according to a further embodiment of the invention.
Figure 11:
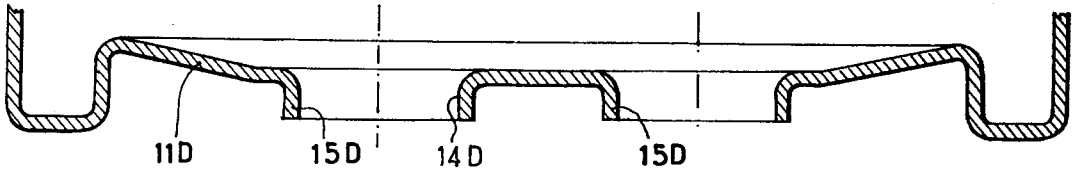
FIG. 11 is a cross-sectional view at a larger scale along line XI—XI of FIG. 10.

In the alternative embodiment shown in FIGS. 10 and 11, the collars 15D defining the holes 14D of plate 11D are without annular shoulders.

The embodiments of the hollowed plate according to the invention shown in FIGS. 4 through 9 allow fitting on the plate tubes 18 identical to those which would be fitted on a plane plate of the prior art. On the other hand, in the embodiment of FIGS. 10 and 11, the tubes to be fitted must have flared-out portions at their ends placed at a level corresponding to that of collars 15D, and which are therefore different from the tubes which would be fitted in a plane plate of the prior art.

Generally, the collars defining in a hollowed plate according to the invention the holes for fitting the heat exchanger tube ends can be all at the same level or at different levels.

I claim:

1. A hollowed tube plate for a heat exchanger having at least a water box and fluid flow tubes, the ends of which are to be engaged and tightly fitted in holes of the tube plate, said tube plate comprising:

U-shaped edges provided for tight mounting on edges of the water box;

a central portion of a substantially plane shape in which are formed the holes for the fitting of the tube ends;

and slanting planes connecting said plane central position with said U-shaped edges, so that the tube plate has a deflected general shape.

2. A hollowed plate according to claim 1, wherein said plate is deflected on the side of the tube nest.

3. A hollowed plate according to claim 1, wherein the edges of said holes form cylindrical collars and said collars have top portions at a level below the level of the non deflected edges portions of said plate.

4. A hollowed plate according to claim 3, wherein the top portions of said collars are at the same level.

5. A hollowed plate according to claim 3, wherein the top portions of said collars are at different levels.

6. A hollowed plate according to claim 1, wherein the edges of said holes form cylindrical collars and said collars have their top portions at the same level as the non deflected edge portions of said plate.

7. A hollowed plate according to claim 6, wherein said collars are surrounded by annular shoulders formed by folded portions of the plate and forming said top portions.

8. A hollowed plate according to claim 7, wherein said shoulders have touching edges.

9. A hollowed plate according to claim 7, wherein two transversely adjacent shoulders are connected to each other via a plane portion.

10. A hollowed plate according to claim 9, wherein said plane portion is at the same level as the top portion of said shoulders.

11. A hollowed plate according to claim 7, wherein the edges of said shoulders are not touching.

12. A hollowed plate according to claim 11, wherein said plane portion is at a lower level than that of the top portions of said shoulders.

* * * * *